US010805746B2

(12) United States Patent
Bolsman et al.

(10) Patent No.: US 10,805,746 B2
(45) Date of Patent: Oct. 13, 2020

(54) VALVE, A TRANSDUCER COMPRISING A VALVE, A HEARING DEVICE AND A METHOD

(71) Applicant: Sonion Nederland B.V., Hoofddorp (NL)

(72) Inventors: Caspar Titus Bolsman, Hoofddorp (NL); Laurens de Ruijter, Hoofddorp (NL); Petrus Egbertus Henricus Hermsen, Hoofddorp (NL); Erik Marinus Krom, Hoofddorp (NL); Nishant Lawand, Hoofddorp (NL); René Maas, Hoofddorp (NL); Theodorus Geradus Maria Brouwer, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/160,091

(22) Filed: Oct. 15, 2018

(65) Prior Publication Data

US 2019/0116437 A1 Apr. 18, 2019

(30) Foreign Application Priority Data

Oct. 16, 2017 (EP) ..... 17196714

(51) Int. Cl.
*H04R 25/00* (2006.01)
*H04R 11/02* (2006.01)
*H04R 1/10* (2006.01)

(52) U.S. Cl.
CPC ..... *H04R 25/65* (2013.01); *H04R 11/02* (2013.01); *H04R 25/604* (2013.01); *H04R 1/1041* (2013.01); *H04R 25/456* (2013.01); *H04R 2225/021* (2013.01); *H04R 2225/023* (2013.01); *H04R 2225/025* (2013.01); *H04R 2460/11* (2013.01); *H04R 2460/13* (2013.01)

(58) Field of Classification Search
CPC ..... H04R 2460/11; H04R 2225/025; H04R 11/00
See application file for complete search history.

(56) References Cited

U.S. PATENT DOCUMENTS 4,893,655 A 1/1990 Anderson
5,222,050 A * 6/1993 Marren ..... H04R 1/44 181/132
5,984,269 A 11/1999 Short, III
(Continued)

FOREIGN PATENT DOCUMENTS

EP 1 840 869 A1 10/2007
EP 2071872 A1 6/2009
(Continued)

OTHER PUBLICATIONS

Extended European Search Report for Application No. EP 18200513.2, dated Feb. 22, 2019 (4 pages).
(Continued)

*Primary Examiner* — Sunita Joshi
(74) *Attorney, Agent, or Firm* — Nixon Peabody LLP

(57) ABSTRACT

A sound channel with a valve positioned in a sound channel, the valve based on an electro-magnetic positioned in a housing positioned in the sound channel without sound travelling through the housing. The valve may be used in hearing devices.

26 Claims, 16 Drawing Sheets

(56) References Cited

U.S. PATENT DOCUMENTS

Figure 1:
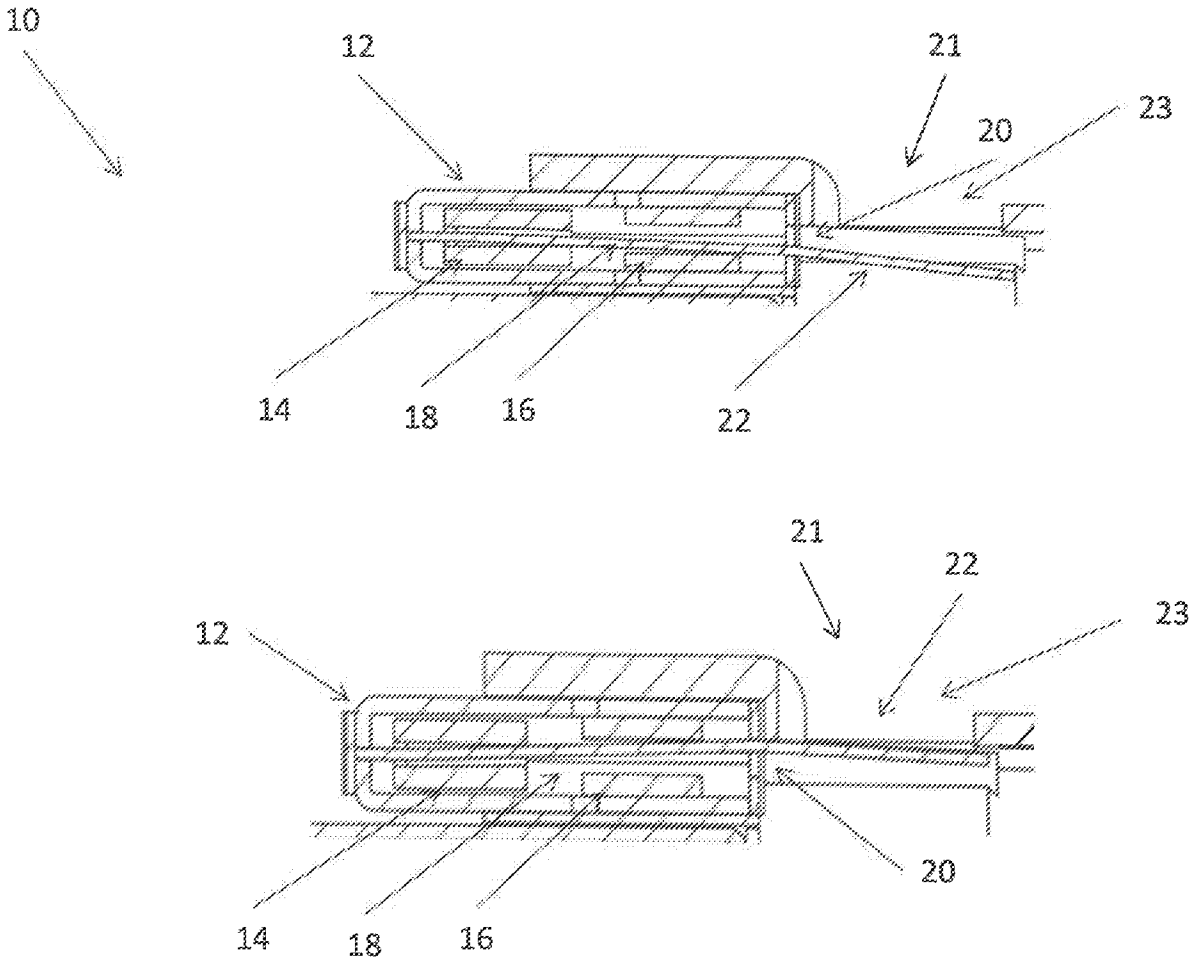

| | | | |
|---|---|---|---|
| 6,512,435 | B2 | 1/2003 | Van Namen |
| 6,549,635 | B1 | 4/2003 | Gebert |
| 6,639,496 | B1 | 10/2003 | Van Namen |
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doom |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenborn |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 8,798,304 | B2 | 8/2014 | Miller |
| 2009/0285437 | A1 | 11/2009 | Takigawa et al. |
| 2010/0061582 | A1 | 3/2010 | Takigawa et al. |
| 2010/0061852 | A1 | 3/2010 | Takigawa et al. |
| 2011/0129108 | A1* | 6/2011 | Miller ..... H04R 1/326 381/322 |
| 2011/0182453 | A1 | 7/2011 | van Hal |
| 2011/0189880 | A1 | 8/2011 | Bondo |
| 2011/0268292 | A1 | 11/2011 | Suvanto et al. |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0136284 | A1 | 5/2013 | van Hal |
| 2013/0142370 | A1 | 6/2013 | Engbert |
| 2013/0163799 | A1 | 6/2013 | Van Halteren |
| 2013/0195295 | A1 | 8/2013 | van Halteren |
| 2014/0169603 | A1 | 6/2014 | Sacha |
| 2014/0305735 | A1 | 10/2014 | Van Halteren |
| 2016/0255433 | A1 | 9/2016 | Grinker |
| 2017/0208382 | A1* | 7/2017 | Grinker ..... G10K 11/17881 |
| 2017/0251292 | A1 | 8/2017 | Wiederholtz |

FOREIGN PATENT DOCUMENTS

| | | | |
|---|---|---|---|
| EP | 2134107 | A2 | 12/2009 |
| EP | 2164277 | A2 | 3/2010 |
| EP | 2345259 | A2 | 7/2011 |
| EP | 2 747 455 | A2 | 6/2014 |
| EP | 3177037 | A2 | 6/2017 |
| WO | WO 2010/042613 | A2 | 4/2010 |
| WO | 2014030998 | A1 | 2/2014 |
| WO | 2019052714 | A1 | 3/2019 |
| WO | 2019052715 | A1 | 3/2019 |

OTHER PUBLICATIONS

Partial European Search Report for Application No. EP 18200516, dated Feb. 20, 2019 (5 pages).

Cox, R.M.; "Acoustic aspects of hearing aid-ear canal coupling systems"; Monographs in Contemporary Audiology, vol. 1, No. 3, pp. 1-44; Mar. 1, 1979; XP007905558 (48 pages).

* cited by examiner

VALVE, A TRANSDUCER COMPRISING A VALVE, A HEARING DEVICE AND A METHOD

The present invention relates to a valve controlled by a deflectable armature provided in a housing through which sound controlled by the valve need not travel.

Valves driven by armatures may be seen in US2016/0255433, US2017/0208382, EP2345259, US2014/305735 and EP3177037.

In a first aspect, the invention relates to a sound channel at least partly defined by a wall portion having therein an aperture, the sound channel comprising a valve having a closing element configured to, in a first position, close the aperture and, in a second position, not close the aperture, and an actuator, the actuator having:

a housing with an opening, the sound channel extending at least predominantly outside of the housing, and an electro-magnetic structure with a moving element, the electro-magnet structure being provided in the housing, wherein the moving element extends from inside the housing, through the opening to the closing element positioned outside of the housing.

The present valve is useful also for miniature elements, such as when the housing has a longest dimension being 6 mm or less, such as 5 mm or less, such as 4 mm or less.

In the present context, a valve may be an element which may be used for controlling sound, through the aperture. Often, a valve is configured to close the aperture and open the aperture. In this context, "open" and "closed" will depend on what is desired controlled. When controlling sound, the aperture need not be hermetically closed, as sound may be sufficiently attenuated even if the aperture still has a small opening. In this context, "open" and "closed" may, for sound control, be defined to a desired degree of sound attenuation and/or in relation to a minimum and maximum size of the aperture when closed or not closed by the closing element.

"Closed" may mean that ail frequencies within a predetermined interval, such as 20 Hz-20 kHz or 700-2000 Hz are attenuated at least 3 dB, such as at least 6 dB, such as at least 10 dB, such as at least 30 dB. "Closed" may additionally or alternatively mean that a cross sectional area of any opening between the closing element and the aperture has a cross section of no more than 0.157 $mm^2$, such as no more than 0.15 $mm^2$, such as no more than 0.125 $mm^2$, such as no more than 0.12 $mm^2$, such as no more than 0.1 $mm^2$, such as no more than 0.08 $mm^2$, such as no more than 0.05 $mm^2$, such as no more than 0.02 $mm^2$.

"Open" may mean that no frequency within a predetermined interval, such as 20 Hz-20 kHz or 700-2000 Hz is attenuated more than 5 dB, such as no more than 3 dB, such no more than 2 dB. "Open" may additionally or alternatively mean that a cross sectional area of the aperture or a portion thereof not blocked by the closing element, is at least 0.05 $mm^2$, such as at least 0.07 $mm^2$, such as at least 1 $mm^2$, such as at least 1.2 $mm^2$, such as at least 1.5 $mm^2$, such as at least 2 $mm^2$, such as at least 2.2 $mm^2$, such as at least 2.5 $mm^2$, such as at least 3 $mm^2$, such as at least 4 $mm^2$, such as at least 5 $mm^2$.

The closing element is configured to close the aperture when in the first position. Thus, the closing element is preferably configured to abut the aperture at least at a large proportion of a circumference of the aperture, such as at at least substantially the entire circumference of the aperture.

Naturally, the aperture may have any shape, such as oval, circular or the like. The aperture may comprise a number of apertures if desired, where the closing element then may be configured to block or close all apertures when in the first position. An aperture may be formed in a straight or plane element, such as a wall or plane surface. Alternatively, the aperture may be provided in a bent or curved element, such as in a wall of a tube or channel. Then, the closing element should be shaped to conform to at least substantially that shape in order to be able to close the aperture sufficiently.

In the second position, the closing element does not close the aperture. Depending on the requirements, the closing element may still cover the aperture partially or not at all. Additional positions of the closing element may be defined in which the aperture is only partially closed if desired.

The closing element may be movable, such as translatable, rotatable, bendable or combinations thereof in order to transfer from the first to the second position or vice versa. Often, the aperture is provided in a sound channel, where the first and second positions are positions at different positions along the longitudinal direction of the sound channel, so that a simple translation along the longitudinal direction may transfer the closing element from the first to the second position and vice versa. Naturally, the movement may be in any direction, such as perpendicular to the sound channel.

In one embodiment, the aperture to be closed may be formed by an inner surface of a channel, such as a tube, where the closing may be a deformation of the channel/tube, so that the closing element may be a part of the channel/tube.

The actuator has an electro-magnetic structure with a moving element which extends to the closing element. Actually, the moving element may form the closing element.

An electro-magnetic structure often is based on one or more coils and optionally one or more magnets, magnetisable materials or the like. Often, a current fed to a coil will make another element move in relation to the coil. This other element may itself be a coil or a magnet or the like.

Then, the moving element may comprise a coil, a magnet or a magnetisable material, so that this may move in relation to another portion of the structure and/or the housing.

As will be described below, the moving element may form part of the drive, such as part of a coil, a magnet, an armature or the like, or the moving element may be attached thereto.

The actuator preferably has the function of bringing the closing element from the first position to the second position or vice versa. This may be obtained by moving the moving element and thus, optionally via an intermediate drive element, move the closing element.

The actuator has an opening through which the moving element extends. Thus, the closing element preferably is positioned outside the housing, so that the sound to be controlled by the valve may flow outside of the housing and not, at least to any significant degree, in the housing. The housing may have additional openings if desired, such as an opening for receiving a current to be fed to the drive coil. Preferably, the housing has no additional openings or no additional openings which are "open" within the above definition.

The valve has a portion of the moving element leg extending through the opening to the closing element.

In one embodiment, the first and second positions are positions with a relative distance of at least 0.1 mm, but preferably, the "stroke" of the movement is at least 0.3 mm, such as at least 0.5 mm, such as at least 1 mm, such as at least 1.5 mm.

In situations where the valve is used in a hearable or hearing aid for creating both an open and a closed use scenario, i.e. where sound from the surroundings is allowed (or prevented from) to pass the hearable or hearing aid and impinge on the ear drum, it is desired that the valve opening is sufficiently large to actually allow sound to pass.

Relevant parameters of a sound path to be opened/closed may be seen in Applicants applications filed on even date and titled "A PERSONAL HEARING DEVICE" and "A sound channel element with a valve and a transducer with the sound channel element", filed on even date, which are hereby incorporated by reference.

Naturally, the moving element portion extending cut of the housing may be made of the same material as the portion of the drive to which the moving element is connected inside the housing, but this is not required. Thus, the moving element may be made of e.g. a lighter material, as this may be require less force and thus energy to move.

The moving element naturally may be fastened to a portion of the "internal" drive but may alternatively be fastened to or extend from other portions of the drive.

Often, the housing is orientated so that the movement of the moving element corresponds to the desired movement of the closing element between the first and second positions.

In one situation, the closing element is formed by a portion of the moving element. Thus, the moving element portion may be not only positioned so as to be in the first and/or second positions and be moved there between during movement of the moving element, but the shape and potentially other properties of the moving element portion may make it suitable for closing/blocking/sealing the aperture. Other properties of the moving element and thus closing element, compared to the desired materials of the internal portion of the drive, may relate to surface softness, sealing properties, weight, shape ability or the like.

In a preferred embodiment, the electro-magnetic structure comprises:

a magnet structure with a magnet gap and a drive coil with a coil tunnel, wherein the moving element comprises a deflectable armature leg extending through the magnet gap and the coil tunnel.

Thus, in this respect, the armature leg extends out of the housing and may be used as the closing element.

The magnet gap preferably is a gap or tunnel in which a magnetic field exists. Often, magnet structures have one or more magnets for creating the magnetic field and additional elements, often called a yoke, configured to guide the magnetic field outside of the magnet gap. Usually, the magnet gap is formed between two adjacent and parallel surfaces between which a magnetic field exists.

The drive coil preferably is a coiled electrical conductor. A single conductor often is used, but a coil may comprise multiple conductors if desired. The coil preferably is configured to provide a magnetic field in a portion of the armature leg extending within the coil tunnel and the magnet gap so that the interaction of the magnetic fields will exert a force on the armature leg portion.

The coil tunnel may be a portion of the coil around which the windings of the coil are provided.

The armature preferably is an element configured to guide a magnetic field generated in the coil to a portion of the armature leg extending within the magnet gap. Often, armatures of this type are made of metal, such as Al, Ni, Mn, Fe, Cr or alloys thereof.

The armature comprises the deflectable armature leg and may comprise additional portions, such as portions configured to be fastened inside or to the housing in order to attach one end of the armature leg in relation to the housing. E-shaped armatures exist, as do U-shaped armatures and I-shaped armatures.

The armature leg is deflectable, whereby one end thereof may be moved when an opposite end is fixed. The armature leg may be made of a flexible material allowing the armature leg to bend. Alternatively or additionally, the armature leg may comprise a locally bendable portion, such as a narrowing, a neck portion or a hinge, around which the two extreme portions of the armature leg may bend.

Preferably, the external armature leg portion forms part of or is fastened to or engages a part of the internal armature leg portion which moves in relation to the housing during deflection. Often, the larger movement the better.

As is also described below, in a projection on to the longitudinal axis of the armature leg, the larger the distance between the housing or attached portion of the armature leg and the closing element is, the larger can the distance between the first and second positions be. A larger deflection or movement makes it possible to have the first and second positions farther from each other. Then, the aperture may be lamer while still be fully opened and closed, or the distance between the closing element and the aperture may be made larger, creating a larger effective opening of the aperture.

In one embodiment, the armature leg extends from an end of the armature leg attached to the housing, through the housing and the opening and generally away from the opening. The external portion of the armature leg may be bent in relation to the internal portion of the armature leg in order to conform to a direction of the aperture to be closed.

Naturally, the external portion of the armature leg may have a general direction at an angle to the internal portion of the armature leg, such as at least substantially perpendicular thereto, if desired. This would be suitable for some aperture directions relative to the deflection plane of the armature leg.

The armature leg may extend from the housing opening to any extent, as it may be used for conveying movement and thus force/torque from the housing to the closing element which may be positioned at any position in relation to the housing. Thus, the armature leg may extend more than 2 mm away from the housing, such as more than 3 mm, 4 mm, 5 mm, 6 mm or more if desired.

In one situation, the valve further comprises a housing portion extending from the housing at the opening thereof, the housing portion having an cuter contour, the aperture being provided in the extending portion.

Thus, the housing and housing portion may together define, such as in a predetermined plane, an outer contour inside which the aperture is provided, which may be closed by the closing element which preferably is a part of the moving element preferably extending generally in the direction of the internal portion of the moving element. Preferably, no other apertures are provided within the contour, so that the valve may be provided in a sound channel, housing or the like sealing at the outer contour, so that the valve extends across the channel/housing and closes it when the aperture is closed and allows sound to pass, when the valve is open.

In one situation, the valve has a sound input, a sound output and a sound channel between the sound input and the sound output, the sound channel extending through the aperture, where the housing is positioned in the sound channel. Preferably, the only sound passage between the sound input and output is through the aperture. The sound channel may be defined by an outer housing wherein the housing, aperture and closing element are provided.

Thus, the housing is positioned in the sound channel, hut is preferably the sound passage between the input and output does not to any degree comprise an interior of the housing, so that sound at least predominantly travels outside of the housing between the input and the output.

In one embodiment, the housing has only a single opening with a cross sectional area exceeding 0.2 $mm^2$, such as exceeding 0.5 $mm^2$, such as exceeding 1 $mm^2$. This opening is that through which the moving element extends.

A second aspect of the invention relates to a transducer comprising an outer housing, a sound generator and a sound channel according to the first aspect of the invention, where the sound generator and the valve are positioned in the outer housing, the cuter housing having a first opening and a second opening, the aperture of the valve being positioned in a sound passage inside the outer housing and between the first opening and the second opening.

In this context, the transducer may be a hearing aid or hearable or a part thereof. The outer housing may be a shell of a hearable or hearing aid or a housing of a sub part thereof.

A sound generator may be a loudspeaker or a miniature transducer, such as a so-called receiver which is a sound generator often used for hearing aids and the like. Naturally, the sound generator may be based on any technology, such as piezo drive, balanced armature, moving coil or the like. Miniature sound generators often have a longest dimension, such as a longest housing side, of 6 mm or less, such as 5 mm or less, such as 4 mm or less.

The sound generator and the valve are positioned in the outer housing. The outer housing often has a sound output for sound generated by the sound generator. The sound passage provided in the cuter housing may extend between the second opening and the sound output then forming the first opening. This sound passage may be defined by an inner surface of the cuter housing and an exterior surface of e.g. the sound generator, or it may be formed by particular elements defining the channel, such as a tube.

In the sound passage between the second opening and the first opening, the aperture is positioned. As mentioned, the sound passage may comprise a sound guide for transporting sound from the sound emitter to outside of the outer housing. Thus, the aperture may be positioned in a sound passage from outside of the outer housing and into the sound passage.

This passage may be blocked by the blocking element. Thus, sound from outside of the outer housing may be guided into the sound passage via the aperture when open.

In one embodiment, the aperture is positioned at, or may actually form, the second opening. In this manner, the transducer has a controllable sound passage through the outer housing.

In one situation, the outer housing comprises a main housing portion and a spout, where the sound output may be provided in the spout and the second opening in the main housing portion.

A spout is often provided for attachment to e.g. a sound channel or the like. Spouts may also be used themselves as sound outputs from the sound generator.

When a spout is provided, the moving element may extend into the spout, such as when the aperture is provided in the spout. Then, the valve housing may be positioned within the main housing portion so as to not take up space and/or affect the sound guidance in the spout.

A third aspect of the invention relates to a hearing device comprising a transducer according to the second aspect of the invention. In this connection, the housing of the transducer may be an outer housing of the hearing device, or a further housing may be provided which then preferably has an opening to allow sound from outside of the hearing device, such as sound from outside of an ear of a person using the hearing device, is allowed to travel into the housing to the valve, through the valve and toward the eardrum of the person. Thus, this opening is preferably positioned on a portion of the hearing device configured to point away from the head of the person when wearing the hearing device.

Hearing devices may be hearing aids for positioning in the ear canal, in the ear, behind the ear or on the ear. Hearing devices may alternatively be ear phones, ear buds or the like also for persons without impaired hearing.

A fourth aspect of the invention relates to a method of operating a valve of a sound channel according to the first aspect of the invention, the method comprising feeding a current to the drive coil so as to bring the closing element from one of the first and second positions to another of the first and second positions.

The current may be fed in order to keep the moving element moved to a desired degree, or the current may need feeding only to move the movable element, where after the movement or position is maintained using other means. In one situation, the moving element may be moved to a degree where it contacts a magnet system and thus is attracted to the magnet system to a degree maintaining the movement, until a current is again fed to a coil to move the moving element in the opposite direction. In other situations, the moving element may be biased in one direction, so that if no current is supplied, the moving element extends in one direction, defining one of the positions of the closing element, and when a predetermined current is supplied, the moving element is moved to another direction defining the other position of the closing element.

Another aspect of the invention relates to a sound generator comprising an outer housing, a sound emitter having a sound outlet opening and being positioned in the outer housing, a sound outlet element defining a channel extending away from the sound emitter and configured to transport sound from the sound emitter to an output of the sound outlet element, the sound generator further comprising an element configured to alter an inner cross section of the channel at at least one position thereof along a direction of sound from the sound emitter toward the output of the sound cutlet element.

Naturally, the valve or sound channel according to other aspects of the invention may be provided if desired. Thus, this aspect of the invention may be combined with any of the other aspects, embodiments and the like.

The element may be an elongate element which, at least in one position, extends generally in a direction of the channel but which may have a variable angle to an elongate direction of the channel. The element may be rigid and hinged to allow rotation thereof to obtain different angles to the elongate direction. The element may be hinged at a position thereof the closest to the sound emitter and may extend away from the hinged portion. Preferably, the element divides, at the hinged portion, the channel into two portions, where the sound output of the sound emitter is positioned so as to output the sound into one of the parts. Then, varying the angle of the element within the channel will vary the cross section of the portion of the channel experienced by sound output and along the channel. The element may effectively form a tapering channel widening toward the output of the sound output element or narrowing in that direction. Alternatively, the element may be directed to be parallel to the channel axis to form a constant cross section and/or cross sectional area along the axis as far as the channel and/or element extends in that direction.

Preferably, the element is plane or flat and at least substantially spans a width of the channel, preferably in ail positions or at all angles, so as to prevent sound from passing from one side thereof to the opposite side thereof. In that manner, it may effectively affect the cross section of the channel experienced by the sound.

Thus, an adaptable sound channel may be obtained. The adaptability may be made manually, such as in order to adapt the channel to a particular sound emitter or a particular sound desired from the sound outlet opening. Alternatively, an actuator may be provided for rotating the element to obtain a more real-time adaptation if desired.

Naturally, instead of a hinged element, the element may be bendable, permanently or plastically, so as to obtain the same advantages without having to provide a hinge.

A final aspect of the invention relates to a valve having:

an aperture, a closing element and an actuator configured to move the closing element between a first position, in which the closing element closes the aperture and, a second position, in which the closing element does not close the aperture, the actuator having:

a magnet structure with a magnet gap, a drive coil with a coil tunnel, and a housing with a housing opening, the magnet structure and the drive coil positioned in the housing, an armature having a deflectable armature leg being attached to a portion of the housing opposite to the housing opening, extending inside the magnet gap and the coil tunnel, through the housing opening to the closing element, the armature leg having a longitudinal axis and being configured to deflect within a predetermined deflection plane, the closing element being positioned, when the actuator is projected on to a plane perpendicular to the deflection plane and comprising the longitudinal axis, along the longitudinal axis and outside of the housing.

Naturally, this aspect may be combined with the above aspects of the invention, and all elements, features and embodiments are equally valid in this respect. Thus, the coil, magnet structure and housing may be the same as described above as well as the aperture, closing element and the like. The opening/closing may be as described above.

According to this aspect of the invention, the armature leg extends to outside the housing, and the closing element is connected thereto or forms part thereof. The closing element thus again is outside of the housing, so that the sound controlled thereby need not travel through the housing and be attenuated thereby. The housing need not have any other openings than the housing opening. Clearly, if the housing had additional openings so that the sound could also travel through the housing, an overall reduction in sound attenuation could be obtained.

The armature is deflectable and preferably comprises a metal or is made of metal, so that the fields emitted by the magnet and coil may interact to deflect the armature.

The armature leg extends through the housing, normally from one end of the housing to the other, as the armature leg often defines a longitudinal direction of the housing which is usually elongate. The armature or armature leg is attached to the housing either so as to be rotatable or in a fixed manner. The armature leg may deflect due to it bending or due to a hinge portion bending, whereas the remaining portions of the armature leg may be more or less straight. Usually, the longitudinal direction may be that of the armature leg when in a rest position.

The deflection of the armature leg is increased or amplified by the armature leg extending to outside of the housing, so that a closing element driven by a portion of the armature leg outside of the housing will be able to move further than one driven by a portion of the armature leg positioned inside the housing, such as between the magnet structure and the coil.

The deflection takes place in a plane often defined by the magnet structure and/or the cross sectional shape of the armature leg. Armature legs often have an oblong cross section in a plane perpendicular to the longitudinal direction of the armature leg. Thus, the bending or deflection will be a bending in a plane perpendicular to the plane of the larger surface of the armature leg cross section.

Then, when the armature deflects, it moves the closing element between the first position and the second position. Thus, the first and second positions preferably lie in the plane of deflection. Then, the actuator may be oriented, or the aperture and closing element may, so that the deflection brings the closing element between the first and second positions.

When projecting the armature leg, the housing and the closing element on to the longitudinal axis of the armature leg, the armature leg has a portion outside of the housing, and this portion of the armature leg forms or is connected to the closing element. Preferably, the closing element and/or the aperture is completely outside, in the projection, of the housing, but even if only a part thereof is outside of the projection of the housing, a larger movement of this part of the closing element is achieved. The larger the distance, in the projection, between the housing (or the attached armature leg portion) and the closing element, the larger the distance is possible between the first and second positions.

Naturally, the armature leg may itself, such as an extreme portion thereof opposite to that attached to the housing, form the closing element. Then, the armature leg may itself close the aperture in the first position.

Alternatively, the armature leg may drive the closing element, such as if the closing element is attached to or moved by the armature leg. The closing element may be made of any material and may be directly or indirectly attached to or driven by the armature leg. In fact, the closing element may be rotatable around a hinge between the first and second positions, where it may be brought between the positions by the deflection of the armature leg.

Between the armature leg and the closing element, a drive member of any type, usually a rather stiff element, may be used for transferring movement from the armature leg to the closing element. This drive member may be replaced by —or formed by —a portion of the armature leg which may be shaped to arrive at the desired shape for reaching the position of the closing element.

Figure 2:
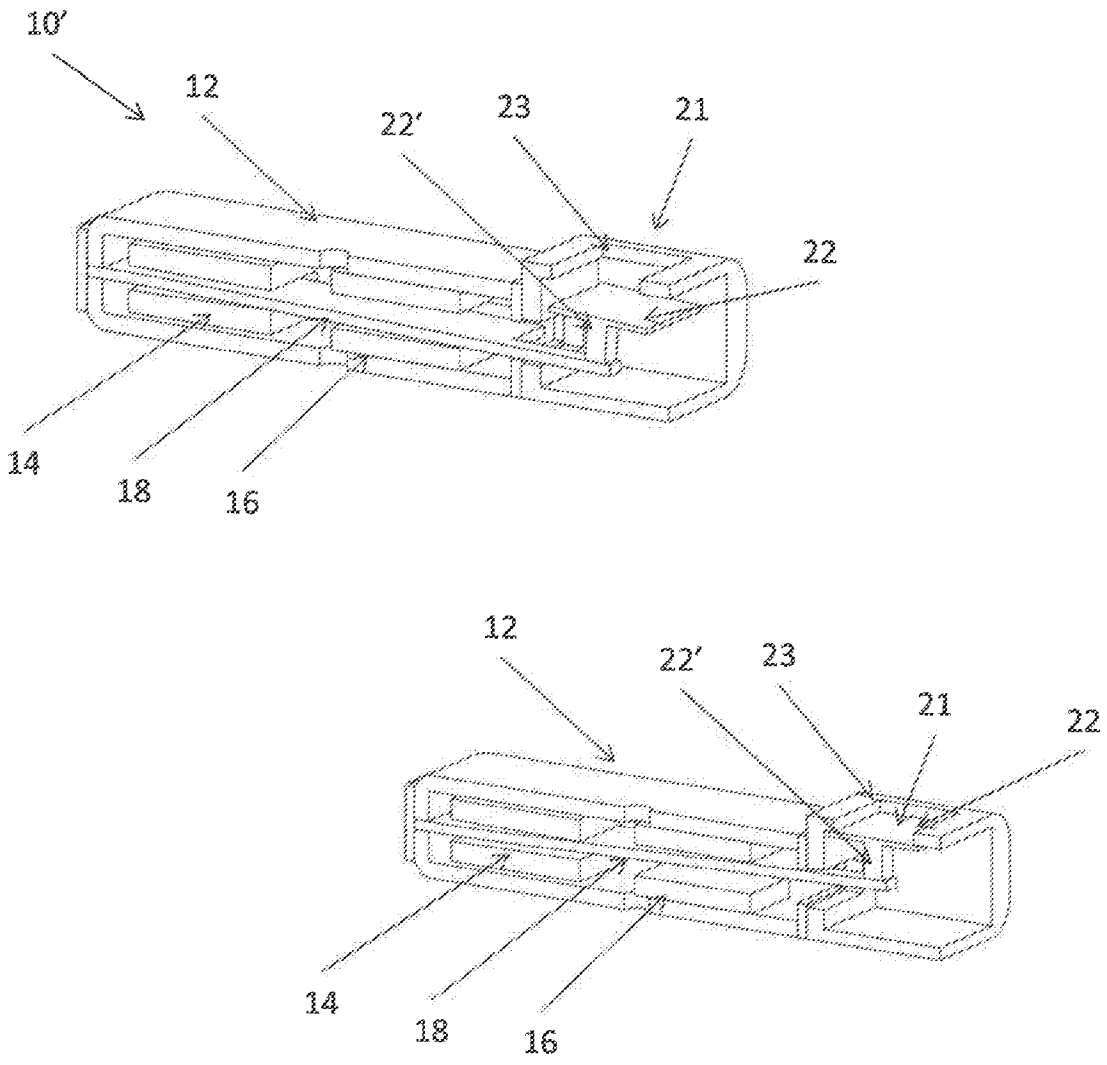
Figure 3:
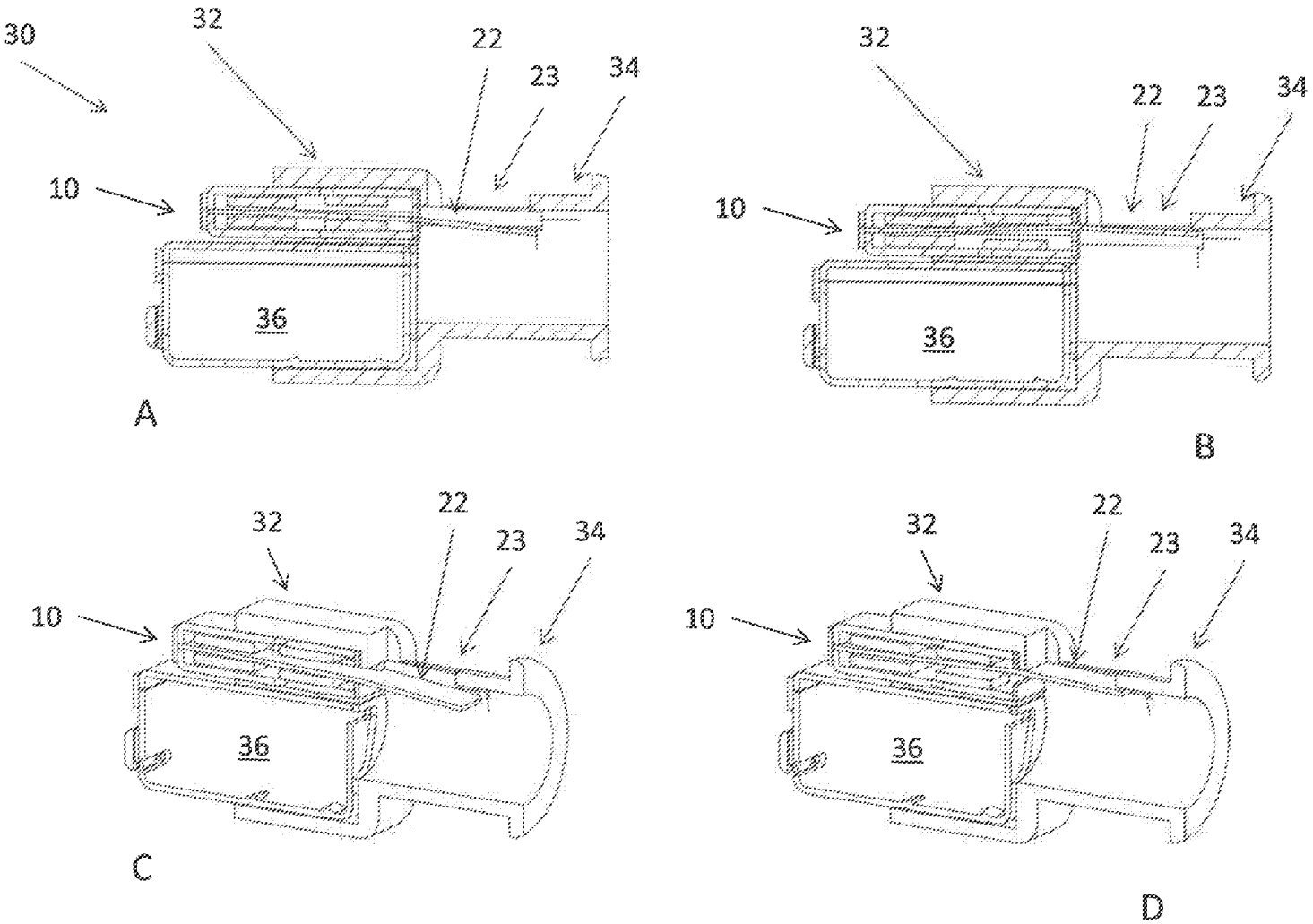
Figure 4:
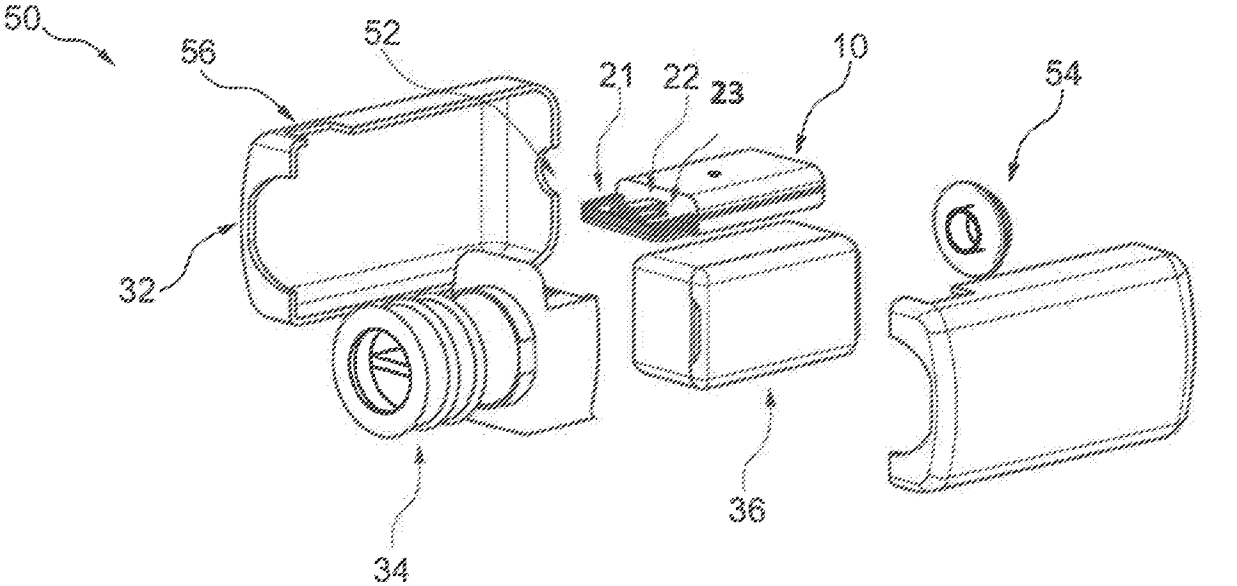
Figure 4:
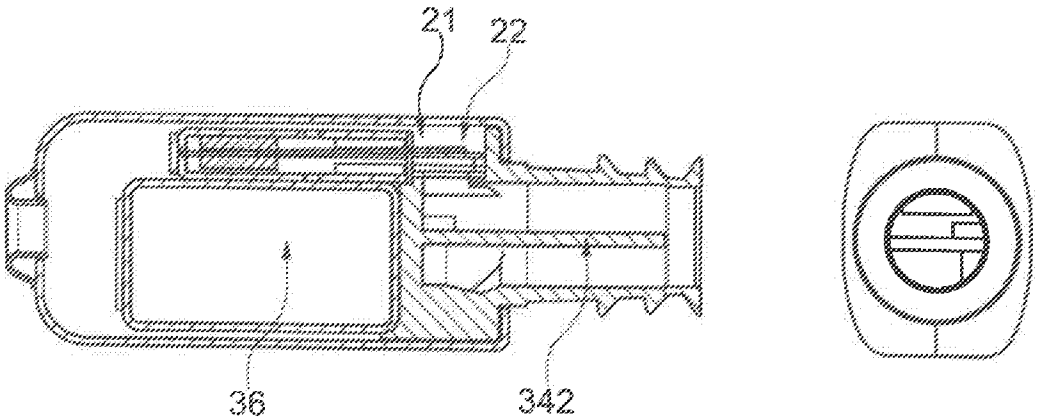
Figure 5:
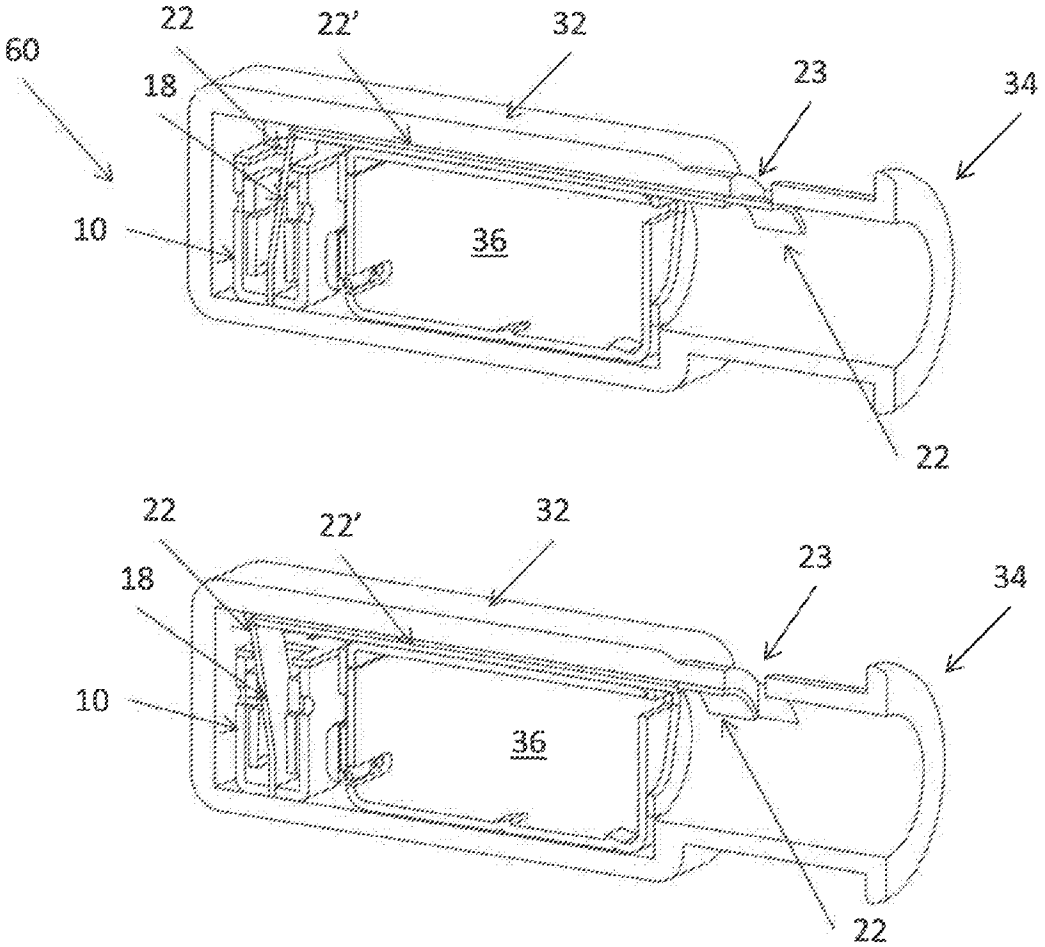
Figure 6:
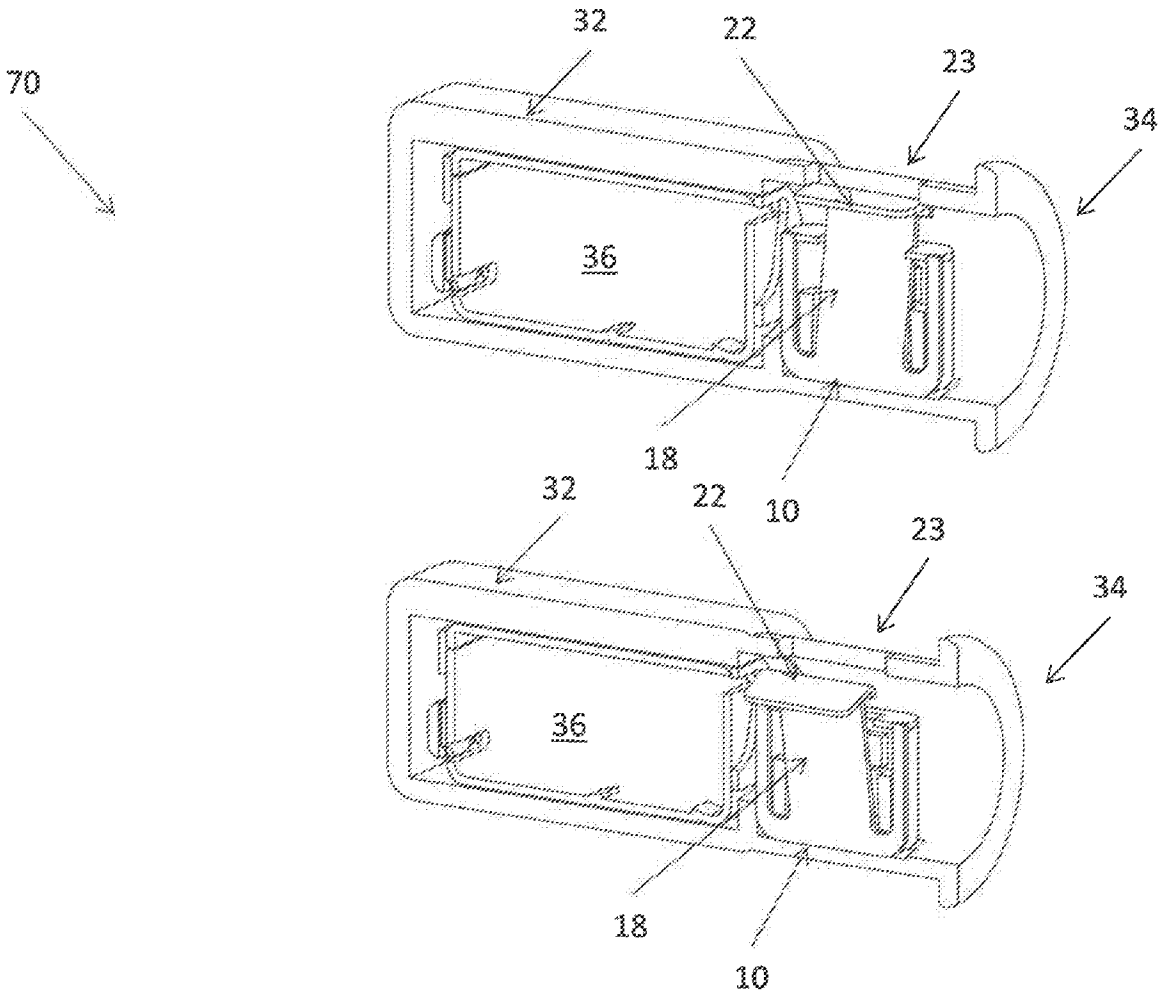
Figure 7:
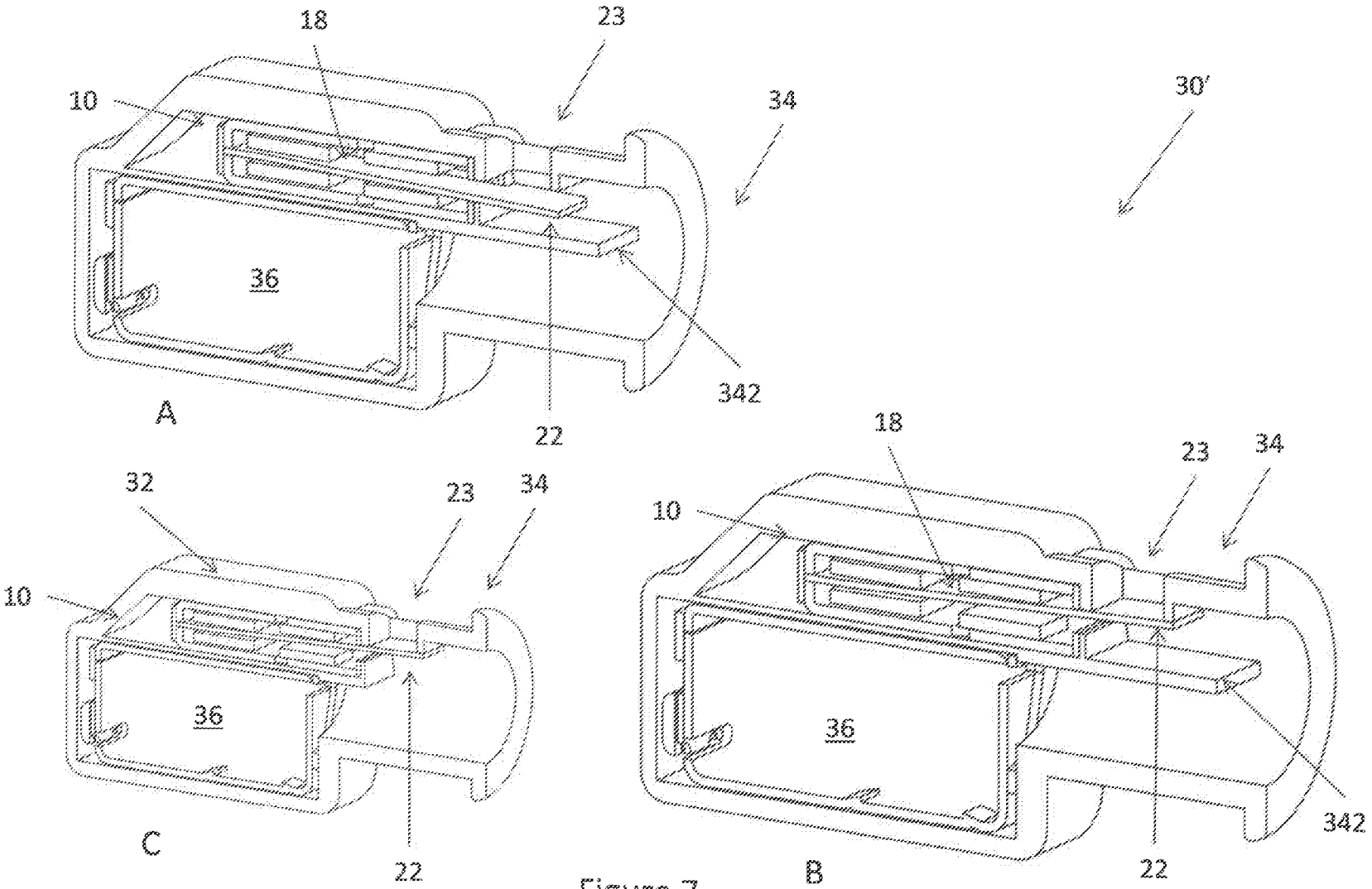
Figure 8:
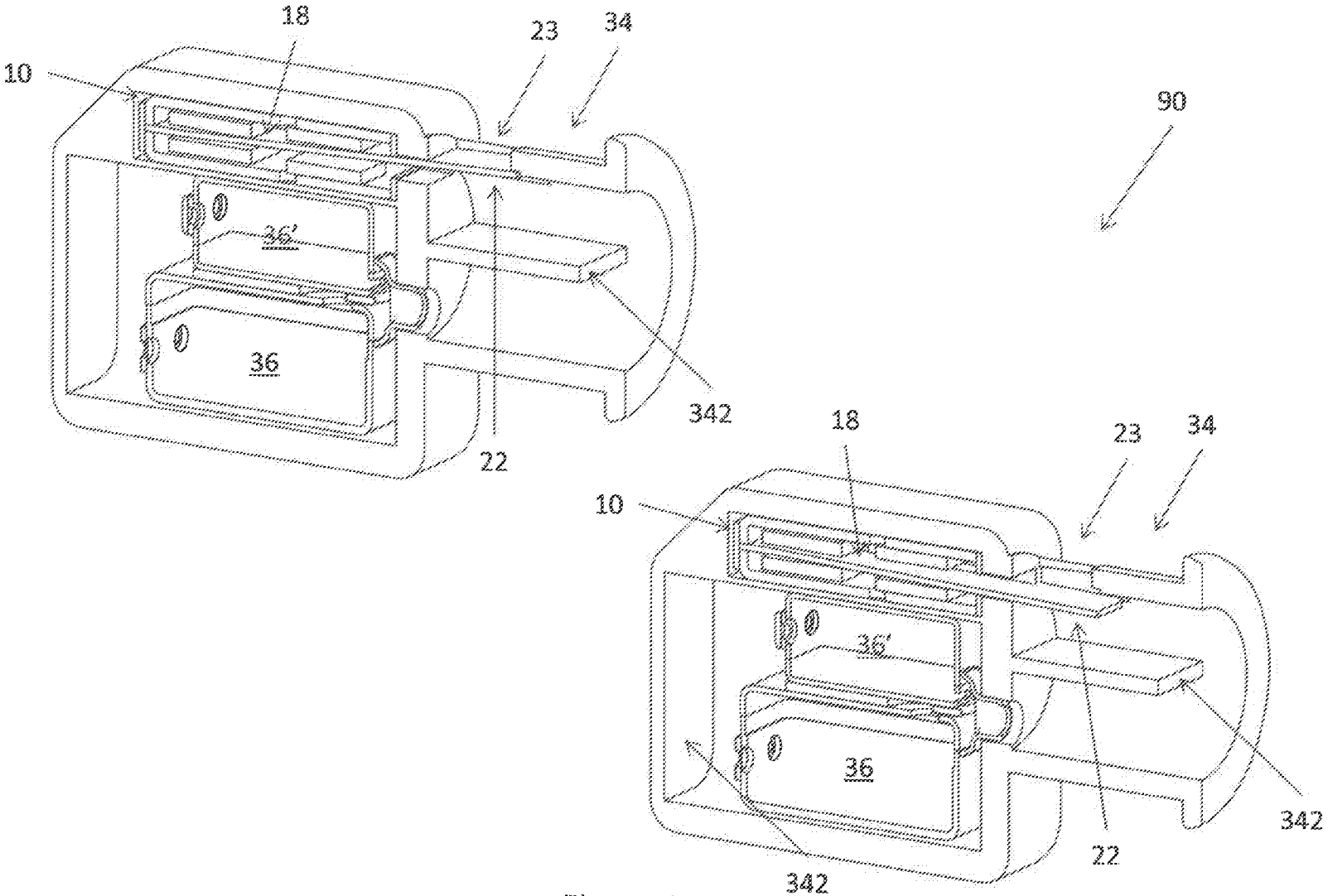
Figure 9:
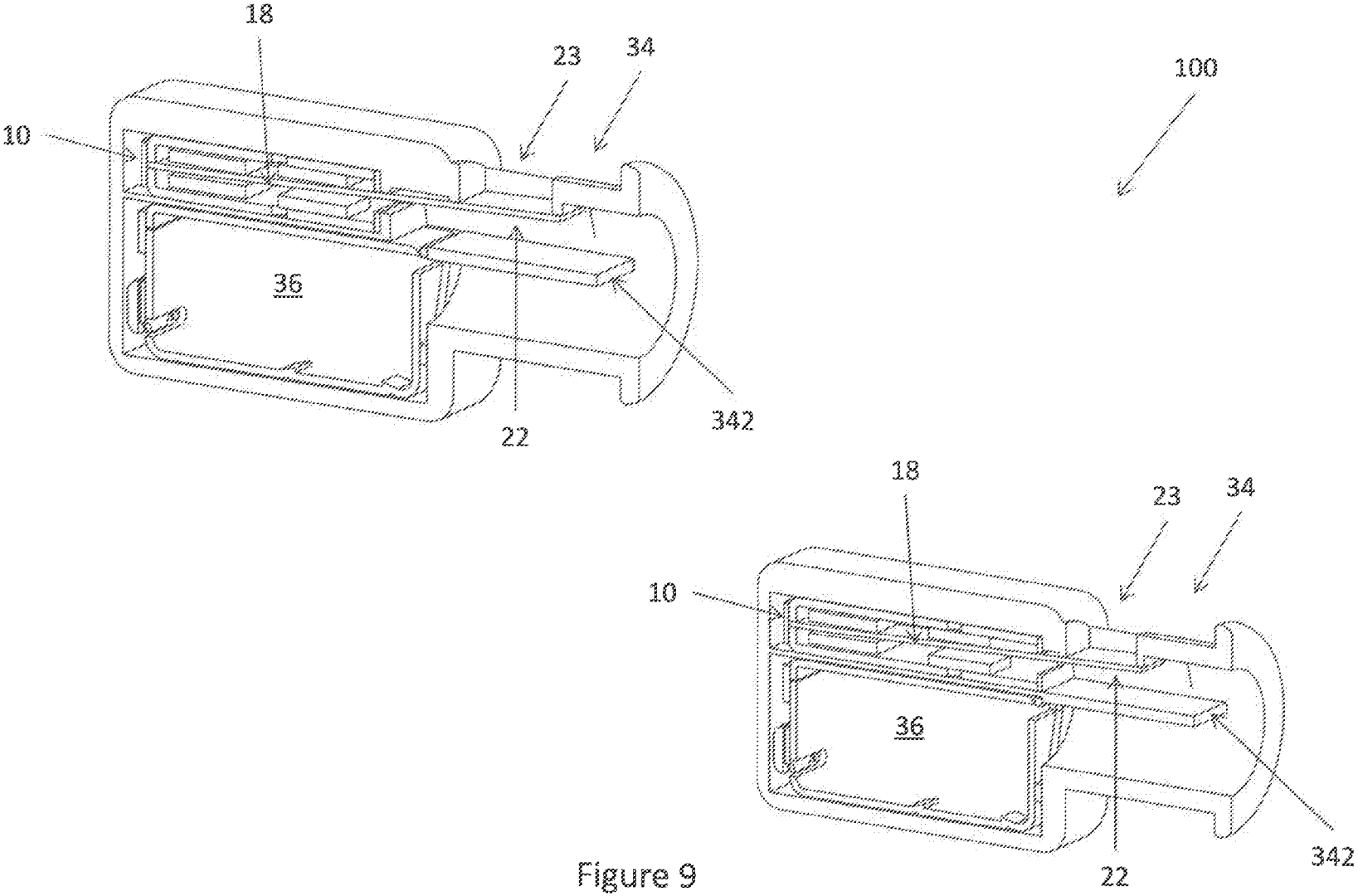

In the following, preferred embodiments will be described with reference to the drawing, wherein:

FIG. 1 illustrates a first embodiment of an actuator according to the invention and in the two different states, FIG. 2 illustrates a second embodiment of an actuator according to the invention, FIG. 3 illustrates a first embodiment of a transducer according to the invention, FIG. 4 illustrates a second embodiment of a transducer according to the invention, FIG. 5 illustrates a third embodiment of a transducer according to the invention, FIG. 6 illustrates a fourth embodiment of a transducer according to the invention, FIG. 7 illustrates a fifth embodiment of a transducer according to the invention, FIG. 8 illustrates a sixth embodiment of a transducer according to the invention, FIG. 9 illustrates a seventh embodiment of a transducer according to the invention.

Figure 10:
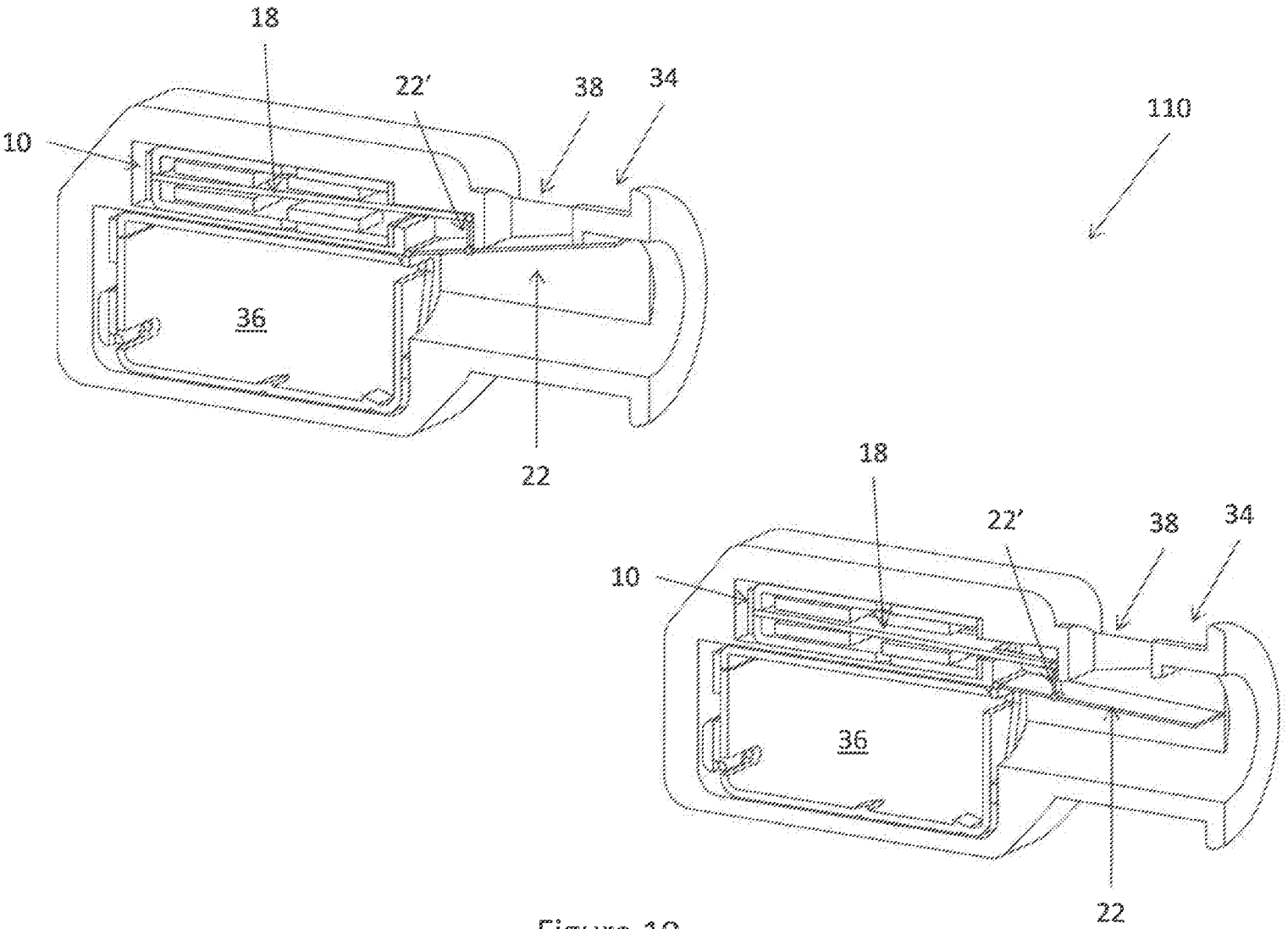
Figure 11:
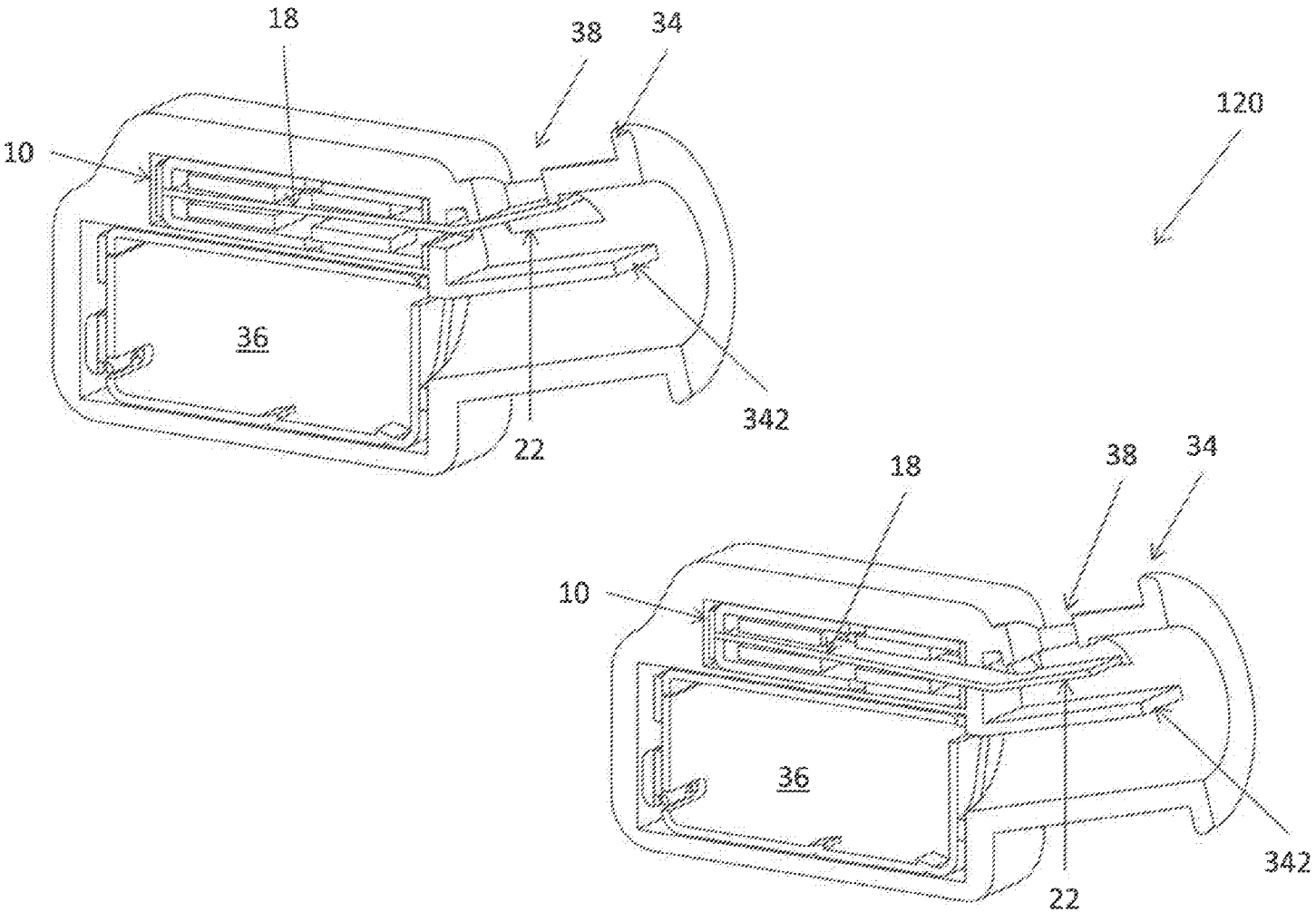
Figure 12:
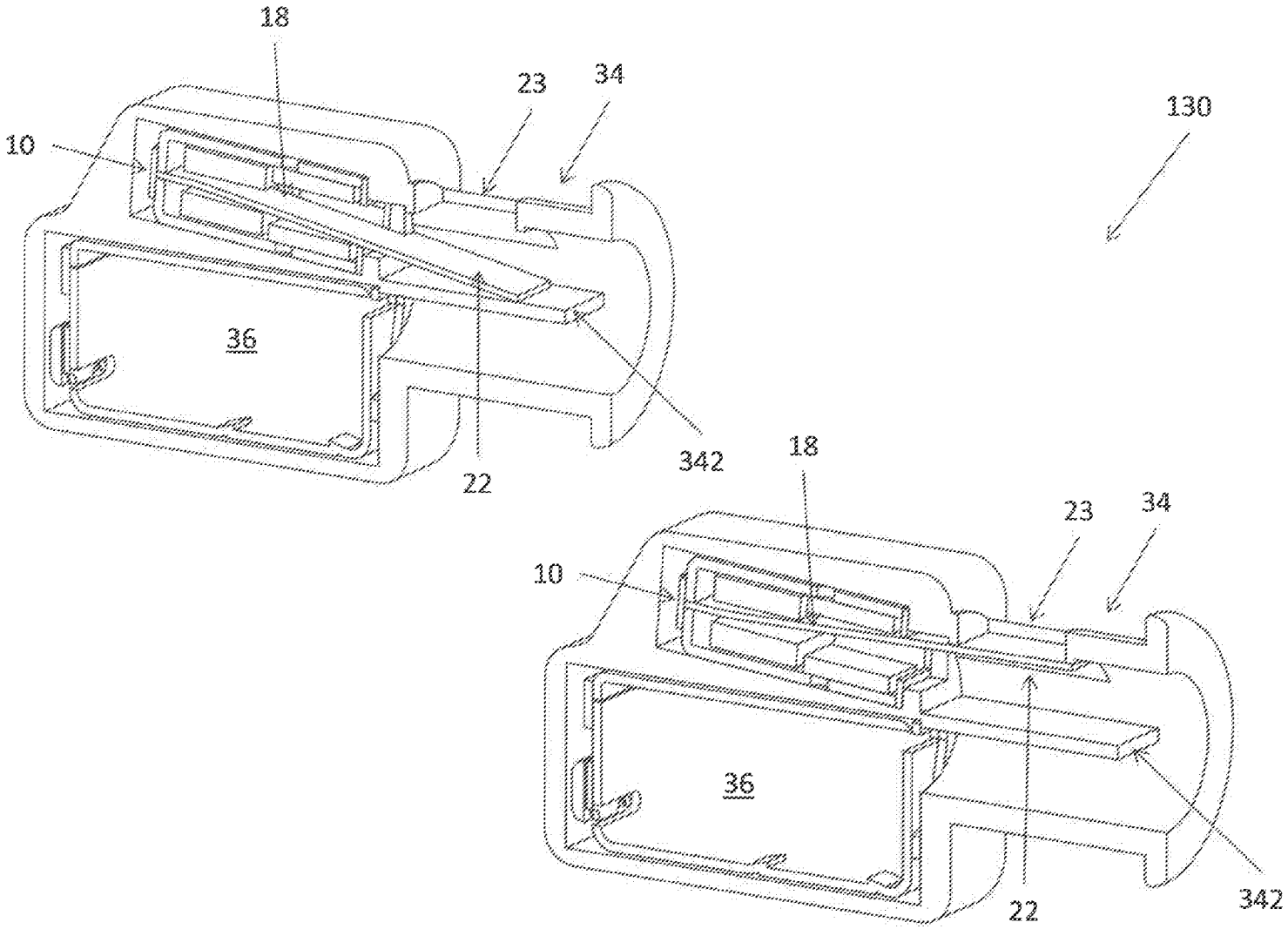
Figure 13:
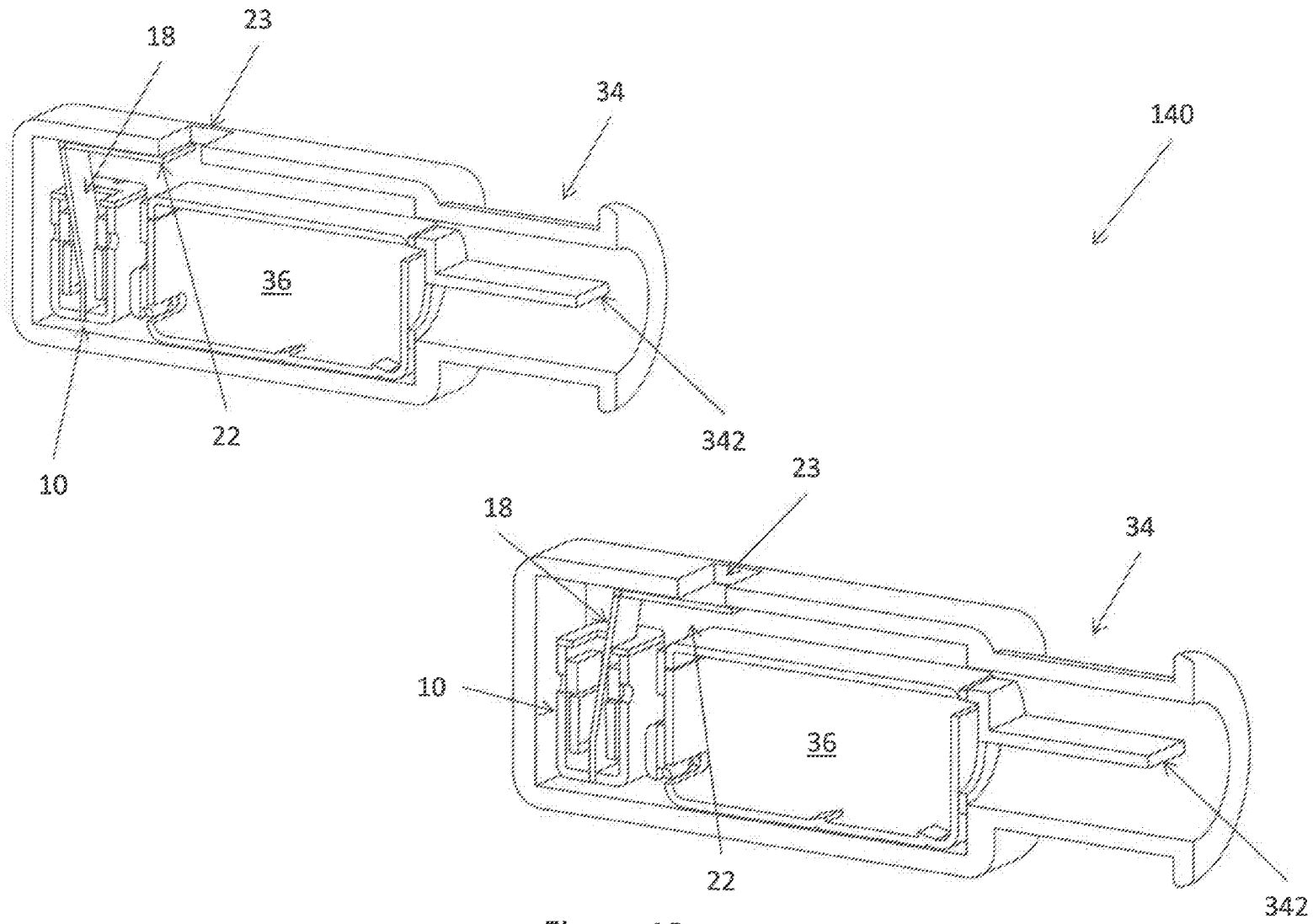
Figure 14:
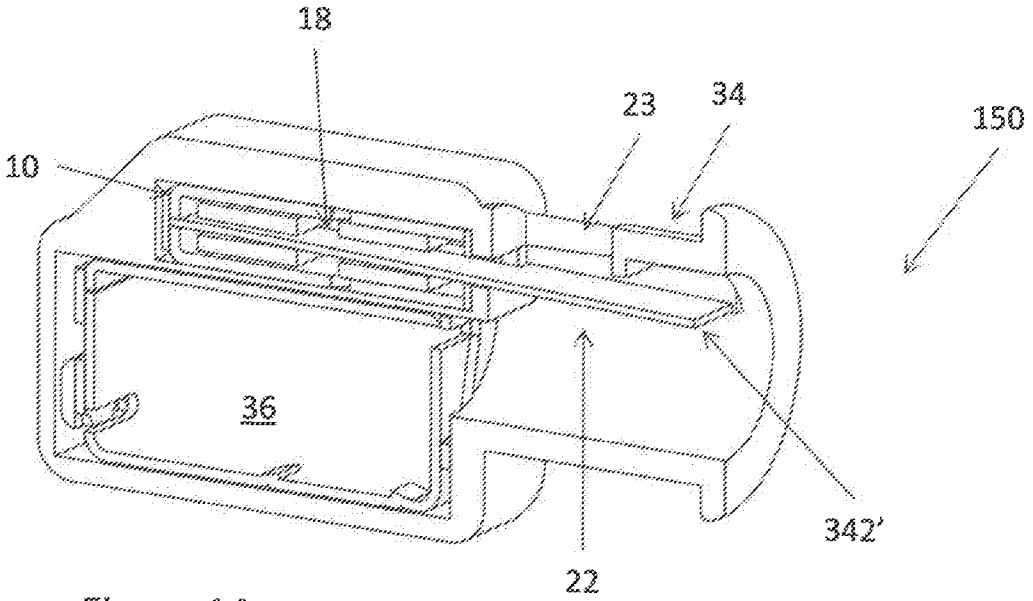
Figure 17:
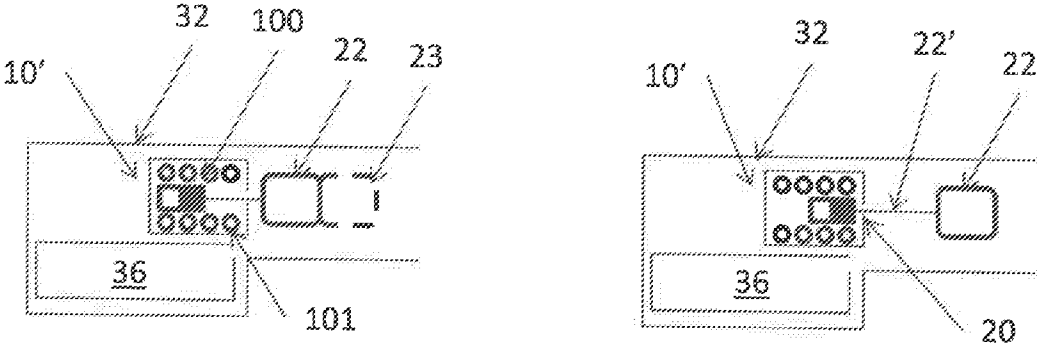
Figure 15:
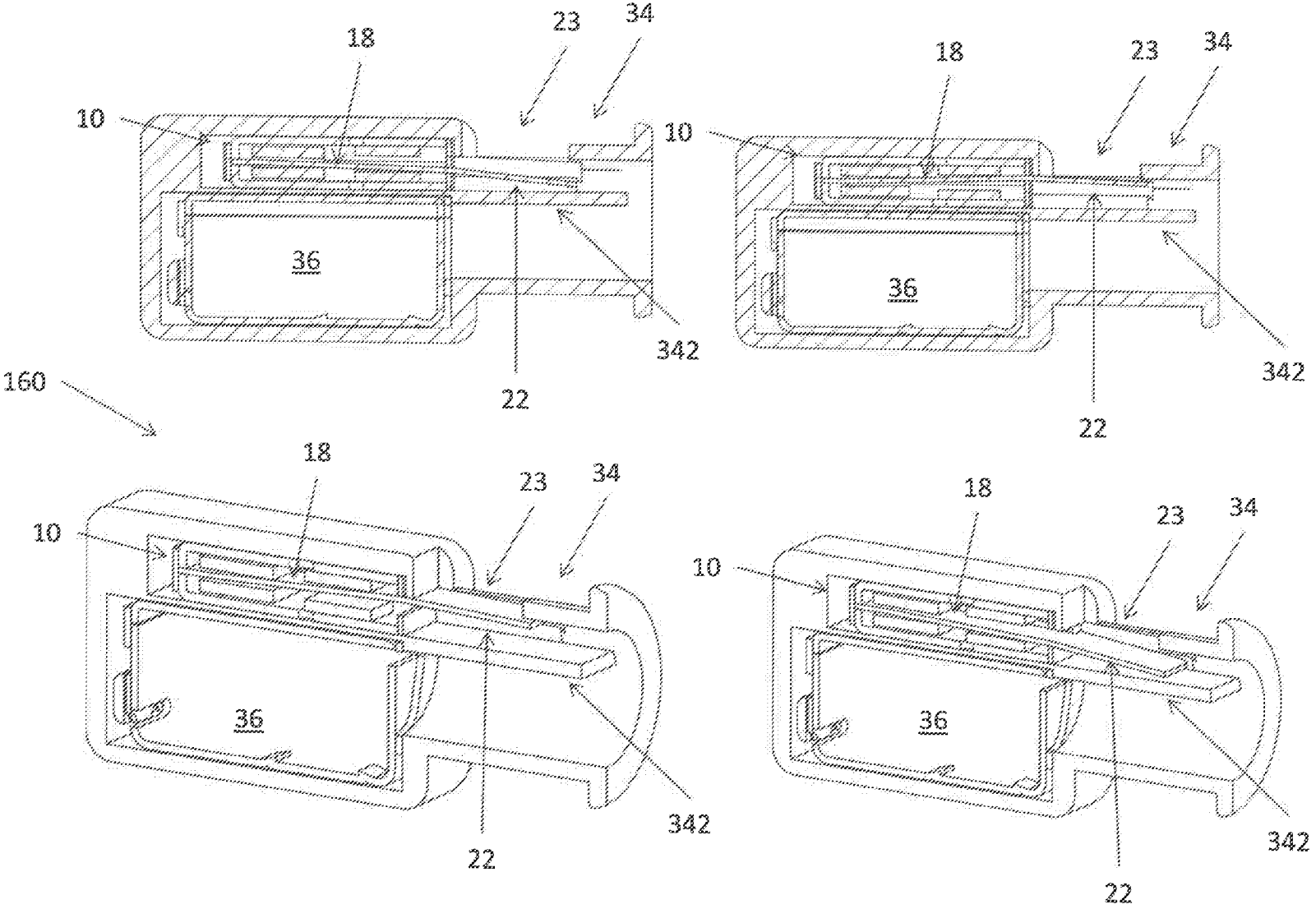
Figure 16:
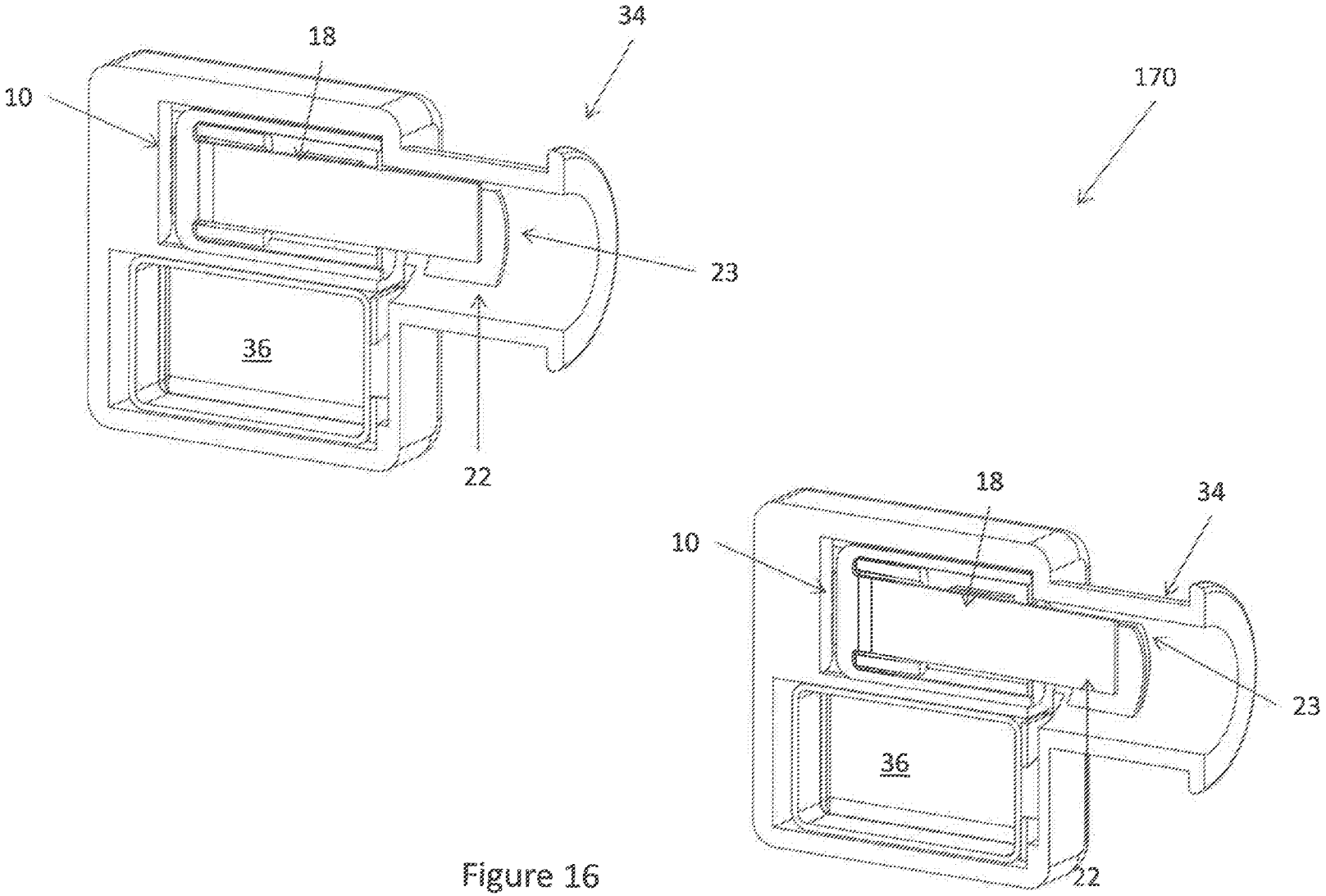

FIG. 10 illustrates a eighth embodiment of a transducer according to the invention, FIG. 11 illustrates a ninth embodiment of a transducer according to the invention, FIG. 12 illustrates a tenth embodiment of a transducer according to the invention, FIG. 13 illustrates a eleventh embodiment of a transducer according to the invention, FIG. 14 illustrates a twelfth embodiment of a transducer according to the invention, FIG. 15 illustrates a thirteenth embodiment of a transducer according to the invention, FIG. 16 illustrates a fourteenth embodiment of a transducer according to the invention, and FIG. 17 illustrates a fifteenth embodiment of a transducer according to the invention.

In FIG. 1, an actuator 10 is illustrated having a housing 12 with an opening 20. In the housing 12, an armature is provided having a deflectable armature leg 18 extending through a coil tunnel in a coil 14 and a magnet gap in a magnet system 16 to the opening 20 which may be opened/closed so as to form a valve. The operation of the armature may be as that of balanced armature receivers or the valves seen in US2017/0208382, US2016/0255433 and EP3177037, where the armature leg conducts a magnetic field generated by the coil into the magnet gap, where the armature leg is exposed to the magnetic field deflecting the armature leg upwardly or downwardly. In usual receivers, the deflection mirrors the current in order to generate sound, but in the present context, the armature movement is used for opening/closing a valve, so the signal fed to the coil usually is a constant current—or a current exceeding or being below a threshold, so that the armature is positioned in an upper or a lower position for opening/closing of the valve.

In some embodiments, the actuator is mono stable so that if no current is fed to the coil, the armature leg is biased toward a stable position, such as the lower or upper position. When a current fed to the coil exceeds a predetermined threshold, the force exerted to the armature leg may overcome the biasing and thus bring the armature leg to the other position. In this type of situation, the armature may be positioned at an angle so that the leg, when not affected by a magnetic field (the current fed to the coil is zero), is in the first position.

In another situation, the leg may be biased by any desirable biasing element, such as a magnetic/electric field, a spring or the like, toward the first position.

A bi-stable actuator may be obtained when the armature leg, when touching the inner surface of the magnet gap at the upper and lower position, will be attracted to the magnet system to a degree overcoming any biasing caused by the deflection of the armature leg. Thus, when the leg is in the upper or lower position, it will stay in that position until an additional force, created by the magnetic field caused by a current fed to the coil, overcomes this attraction and forces the armature leg into the other position, where the leg again touches the magnet system and thus again is in a stable position.

Alternatively, of course, the actuator need not have any stable modes in the outer positions but require the feeding of a current to obtain both of these outer positions.

The armature and coil/magnet systems are provided in a housing 12 having a valve 21 with an opening 20 from which a portion 22 of the armature leg 18 extends. Preferably, the housing 12 has no other opening than the opening 20, or at least no other opening suitable for transporting sound in the audible frequency range of 20 Hz-20 kHz a or at least in the interval of 700 Hz-2000 Hz. Openings of this type usually have a cross sectional area of 2.2 $mm^2$ or more.

An aperture 23 is defined by an element, which aperture is blocked by the portion 22 in the lower illustration but kept open in the upper illustration. Thus, a valve 21 is created opening and closing the aperture 23 using the element 22. The element 22 may be made of the same material as the armature leg 18 or may be made of another material, such as a lighter material, a material not easily transporting a magnetic field, and/or a material providing a desired sealing to the element creating the aperture. Also, the material of the portion 22 may be selected to not provide a sound or vibration when colliding with the element forming the aperture when closing the aperture.

The portion 22 extends from the right-most portion of the armature leg 18 to obtain an even larger up/down deflection than the right-most portion of the armature leg 18. However, the portion 22 is bent slightly in order to conform to the element and thus the contour of the aperture 23.

In FIG. 2, another embodiment of an actuator 10' is seen where a pin shaped portion 22 of the armature leg 18 extends to the closing element 22. Again, the operation of the actuator and the single opening 20 is to have a closing element 22 open or close an opening 23 in a sound channel. In this embodiment, the right-most end of the armature is within the housing.

In general, the actuator 10/10' is used for opening/closing a valve 21. Valves may be embodied in a number of manners. A number of such manners are illustrated in the above references where, however, the valves are built-in in the housings of the actuator, so that the vented sound must travel inside the actuator and thus around the coil etc. therein.

In the present situation, the actuator has the element (armature leg portion 22) extending out of the actuator housing to control a closing element 23 outside of the housing, so that the sound controlled by the valve may travel around the housing without having to interact with the elements in the actuator housing.

In FIG. 3, a sound generator 30 is illustrated having therein a valve controlled by an actuator as seen in FIG. 1. More particularly, an outer housing 32 is provided having a spout 34 for e.g. mounting to a sound guide. In the outer housing 32, a sound generator 36, such as a miniature receiver, is provided configured to emit sound into and out through the spout.

In the top of the spout, an opening or aperture 23 is provided which may act as a vent allowing air from passing from inside the spout to outside the spout and the outer housing 32. Alternatively, the spout or outer housing may be configured to transport air passing from the spout through the opening 23 inside the outer housing, past the receiver/actuator and to another opening in the outer housing, such as at the back thereof (see FIG. 4). The opening 2323 can be closed or blocked by the portion 22 of an armature leg of a transducer 10 as described with reference to FIG. 1.

In figure A, the portion 22 is in its lower position where air/sound is allowed to pass the portion 22 and travel through the opening 23. In figure B, the portion is in its an upper position, closing the opening 23. Then, the opening 23 is dimensioned so that it may be blocked or closed by the portion 22, and the actuator 10 is positioned so that the portion 22, when the armature leg is in the upper position, blocks the opening 23.

Figures C and D illustrate the two positions in an elevated side view of a cross section.

It is noted that from the valve, only the portion 22 extends into the spout 34, so that the sound emitted by the receiver 36 is not blocked by or interfered with to any significant degree by the actuator 10. In FIG. 7, an alternative embodiment 30' is illustrated in which the actuator 10 is moved slightly forward to also extend in front of the receiver.

In FIG. 4, another embodiment of a sound generator 50 is illustrated as a cross section of the assembled product and in an exploded view. Again, the sound generator 50 has an outer housing 32 inside which an actuator 10 and a receiver 35 is provided. A spout 34 is provided engaging the housing 32 and configured to receive sound output by the receiver 36.

In this embodiment, the vent is provided in a different manner in that the actuator 10 comprises an outwardly extending portion 21 extending from the actuator 10 at the armature leg portion 22 and the opening 20. The outwardly extending portion has a surface comprising therein the opening or aperture 23 which again may be opened and/or closed by the armature leg portion 22. The actuator 10 thus now in itself is a valve and may be provided across an air channel which is to be opened/blocked.

In FIG. 4, the actuator 10 is positioned above the receiver 36 but now with the portion 21, and thus the armature leg portion 22, extending in front of the receiver 36. The spout 34 and outer housing 32 are configured to be sealing around the periphery of the receiver 10 and thus also the extending portion 21 so as to block any air flow from the spout 34 to an upper side of the actuator 10. In the present embodiment, a top opening 56 in the outer housing 32 allows air vented through the valve 10 to pass to the outside of the outer housing. Alternatively, a back opening 52 may be provided, in which a spout 54 may be positioned, where a sound passage is defined in the outer housing 32 from the upper side of the portion 21, around the receiver 36/actuator 10 and to the back opening.

In this embodiment, a partition wall 342 is provided in the spout 34. This partition wall has on its lower side the sound output by the receiver 36 and the vent at its upper side. This partition wall has the function of preventing or attenuating sound generated by the receiver 36 from travelling through the vent and to the outside of the outer housing 32 via the opening 52 or the opening 56, which ever is provided.

In FIG. 5, a sound generator 60 is seen having an outer housing 32 with a spout 34. A receiver 36 is provided configured to emit sound into the spout 34.

In the spout, an opening or aperture 23 is provided having a closing mechanism, such as a flap or plate 22, which opens/closes the opening 23 and is controlled by a drive rod 22' connected to the portion of the armature leg 18 extending outside of the housing. The drive rod 22' could be formed by the extending portion if desired.

Thus, the actuator is now positioned in a position further away from the actual valve or aperture while still being able to control it via the drive rod. Naturally, the opening/aperture 23 may be positioned in any desired position of the outer housing, including the spout, and the actuator may be positioned in any desired position, as a drive rod may be provided for conveying the movement of the armature leg to the closing mechanism.

In FIG. 6, another embodiment of a transducer 70 is seen having an outer housing 32 in which a receiver 36 is positioned together with a valve 10 having an armature leg 18 and a closing element 22 closing, in the upper illustration, an aperture 23 in the spout 34 and allowing the aperture, in the lower illustration, to be open.

In this embodiment, the driver or valve 10 is positioned in the spout 34. However, this element may be made so slim that sound output by the receiver 36 may travel around the driver 10 and out of the spout 34.

The deflection of the armature leg 18 is into and out of the plane of the drawing. Thus, the closing element 22 may simply be an extension of the armature leg 18, which extension is shaped to conform to the portion of the spout defining the aperture so as to be able to close the aperture when desired.

FIG. 7 illustrates yet an embodiment wherein the armature leg 18 has an extended portion 22 opening and closing the side opening 23. In illustrations A and B, a dividing portion 342 is provided defining the vent channel as a portion of the element 34. In this manner, sound exiting the emitter 36 must travel a longer way to arrive at the opening 23, thereby reducing the amount of sound which escapes the transducer 80 via the vent through the opening 23.

In this embodiment, the actuator 10 is moved forward of the receiver 36.

In this embodiment, the sound from the emitter 36 enters the channel below the partition 342 which then also acts to shape the channel to accommodate the sound output of the emitter 36.

In one embodiment, the partition 342 may be hinged at the receiver 36 so as to obtain different angles with respect to an axis of the channel in the element 34. Thus, the sound channel experienced by the sound output of the receiver 36 may see a different cross section or cross section variation during transport through the channel. This may adapt the channel to a particular receiver 36 or a particular sound to be output.

In FIG. 8, the single receiver is replaced by a receiver pair of a woofer 36 and a tweeter 36'. The woofer and tweeter have a common spout into the channel. Between the woofer/tweeter and the spout, a filter, such as a well-known Acu-Pass filter (see EP2134107), may be provided to further adapt the sound before launching into the channel.

In FIG. 9, compared to FIG. 7, the actuator 10 has been moved to the back to flush with the back side of the receiver 36. In FIG. 15, the actuator 10 has been moved further to the front to flush with the front side of the receiver 36.

In FIG. 10, a hinged closing element 22 is driven by the extending portion of the armature via the drive portion 22'. Thus, the position of the portion 22 need not extend directly from the armature 18.

In FIG. 11, the spout 34 extends at an angle from the housing 32. Then, the portion 22 is also angled in relation to the armature 18. The spout angle may be advantageous for introduction into an ear canal, as ear canals have a bend.

Naturally, the partition 342 may be omitted if desired.

In FIG. 12, the actuator 10 is angled in relation to the receiver 36. It is seen that the opening provided by the element 22 may be rather large, as a large angular variation of the armature 18 is facilitated.

In FIG. 13, the opening 23 is provided in the top of the housing of the transducer of embodiment 140. Again, the actuator 10 has the extending portion of the armature 18 driving a portion 22', which is now hinged in relation to the armature in order to allow it to be parallel to the wall portion around the opening 23 in both positions. Now, the actuator is rotated compared to the above embodiments.

In FIG. 14, another embodiment is seen wherein the portion 22 is extended further so as to also perform the function, in the open position, as the partition wall 342'.

In FIG. 15, an embodiment is again seen with the partition wall 342.

In FIG. 16, the actuator 10 has been rotated so that the flexing of the armature 18 now opens or closes an opening in yet another position. Clearly, the actuator 10 and receiver 36 may be oriented as desired in the housing 32 in order to open/close openings at any positions and so as to allow the housing 32 to have any desired shape for use in different positions at/in an ear or ear canal.

In general, a wide variety of positions, orientations and elements may be used.

In one embodiment, the element 22 is wider than the armature 18. In this manner, the armature 18 may be made rather thin to even better prevent sound from entering the housing of the actuator 10. Also or alternatively, the portion 22 may be shaped to fit any opening shape, position and orientation independently of a cross section of the armature. As mentioned, the portion 22 may even be made of another material than the armature 18 if desired.

In FIG. 17, an embodiment is seen with another type of electro-magnetic drive, wherein the actuator 10' comprises a magnet 100 positioned within a coil 101. Feeding a current through the coil will make the magnet move to the left or to the right. The magnet is connected to a closing element 22 via an extending portion 22'. It is seen that the closing element 22 has two positions where it closes and opens, respectively, the opening 23.

This is merely an example of another type of electro-magnetic drive which may be used for moving the closing element. Naturally, the extending portion and closing element may form part of the magnet, such as be made of the same material.

Also, the magnet and coil may be interchanged so what the drive is a moving coil drive. Also, the magnet may be replaced by another coil.

The drive is bi-stable or multi-stable, as the magnet will not be biased in any direction when the coil is not powered.

Thus, all embodiments may be interchanged. The drives and the positions of the openings as well as the movement of the closing element may be selected freely.

The invention claimed is:

1. A sound channel at least partly defined by a wall portion having therein an aperture, the sound channel comprising a valve having a closing element configured to, in a first position, close the aperture and, in a second position, not close the aperture, and an actuator, the actuator having:

a housing with an opening, the sound channel extending at least outside of the housing while predominantly bypassing an interior of the housing, and an electro-magnetic structure with a moving element, the electro-magnet structure being provided in the housing, wherein the moving element extends from inside the housing, through the opening to the closing element positioned outside of the housing.

2. A sound channel according to claim 1, wherein the electro-magnetic structure comprises:

a magnet structure with a magnet gap and a drive coil with a coil tunnel, wherein the moving element comprises a deflectable armature leg extending through the magnet gap and the coil tunnel.

3. A sound channel according to claim 1, wherein the sound channel has a sound input and a sound output, the sound channel extending between the sound input and the sound output and through the aperture, the housing positioned in the sound channel.

4. A sound channel according to claim 1, wherein the housing has only a single opening with a cross sectional area exceeding 0.2 $mm^2$.

5. A sound channel according to claim 1, wherein an armature leg portion extending through the opening extends along a general direction of the deflectable armature leg.

6. A sound channel according to claim 5, wherein the closing element is formed by the extending armature leg portion.

7. A sound channel according to claim 5, wherein the extending armature leg portion is made of one material and the deflecting armature leg from another material.

8. A sound channel according to claim 5, further comprising a housing portion extending from the housing at the opening thereof, the housing portion having an outer contour, the aperture being provided in the extending portion.

9. A sound channel according to claim 1, wherein the aperture has a cross sectional area of at least 0.05 $mm^2$.

10. A transducer comprising an outer housing, a sound generator and a sound channel according to claim 1, the sound generator and the valve being positioned in the outer housing, the outer housing having a first opening and a second opening, the aperture of the valve being positioned in a sound passage inside the outer housing and between the first opening and the second opening.

11. A transducer according to claim 10, wherein the aperture is positioned at the second opening.

12. A transducer according to claim 10, wherein the outer housing comprises a main housing portion and a spout having a sound opening, where the first opening is the sound opening and the second opening in the main housing portion.

13. A transducer according to claim 12, wherein an armature leg portion extending through the opening extends along a general direction of the deflectable armature leg, the armature leg portion extending into the spout.

14. A hearing device comprising a transducer according to claim 10.

15. A method of operating a valve of a sound channel according to claim 1, the method comprising:

feeding a current to a drive coil of the electro-magnetic structure so as to bring the closing element from one of the first and second positions to another of the first and second positions; and subsequently not feeding the current to the drive coil while a maintaining means maintains the closing element in the other of the first and second positions.

16. A transducer according to claim 12, wherein the sound channel extends within the spout and, where:

the aperture is provided in the spout, the housing is provided in the main housing portion, and the moving element extends from the housing to the aperture.

17. A valve having:

an aperture, a closing element and an actuator configured to move the closing element between a first position, in which the closing element closes the aperture and, a second position, in which the closing element does not close the aperture, the actuator having:

a magnet structure with a magnet gap, a drive coil with a coil tunnel, and a housing with a housing opening, the magnet structure and the drive coil positioned in the housing, an armature having a deflectable armature leg being attached to a portion of the housing opposite to the housing opening, extending inside the magnet gap and the coil tunnel, through the housing opening to the closing element, the armature leg having a longitudinal axis and being configured to deflect within a predetermined deflection plane, the closing element being positioned along the longitudinal axis and outside of the housing when the actuator is projected on to a plane perpendicular to the deflection plane and includes the longitudinal axis.

18. A valve according to claim 17, wherein the armature leg, the housing and the closing element are positioned so that, when the armature leg, the housing and the closing element are projected on to the longitudinal axis of the armature leg, the armature leg has a portion outside of the housing, and this portion of the armature leg forms or is connected to the closing element.

19. A valve according to claim 17, wherein the armature leg forms the closing element.

20. A valve according to claim 17, wherein the closing element is attached to or movable by the armature leg.

21. A sound channel at least partly defined by a wall portion having therein an aperture, the sound channel comprising a valve having a closing element configured to, in a first position, close the aperture and, in a second position, not close the aperture, and an actuator, the actuator having:

a housing with an opening, the sound channel extending at least predominantly outside of the housing, and an electro-magnetic structure with a moving element, the electro-magnet structure being provided in the housing, wherein the moving element extends from inside the housing, through the opening to the closing element positioned outside of the housing, and wherein the sound channel has a sound input and a sound output, the sound channel extending between the sound input and the sound output and through the aperture, the housing positioned in the sound channel.

22. A sound channel according to claim 21, wherein the housing has only a single opening with a cross sectional area exceeding 0.2 $mm^2$.

23. A sound channel according to claim 21, wherein an armature leg portion extending through the opening extends along a general direction of the deflectable armature leg.

24. A transducer comprising an outer housing, a sound generator and a sound channel at least partly defined by a wall portion having therein an aperture, the sound channel including a valve having a closing element configured to, in a first position, close the aperture and, in a second position, not close the aperture, and an actuator having:

a housing with an opening, the sound channel extending at least predominantly outside of the housing, and an electro-magnetic structure with a moving element, the electro-magnet structure being provided in the housing, wherein the moving element extends from inside the housing, through the opening to the closing element positioned outside of the housing, the sound generator and the valve being positioned in the outer housing, the outer housing having a first opening and a second opening, the aperture of the valve being positioned in a sound passage inside the outer housing and between the first opening and the second opening, wherein the outer housing comprises a main housing portion and a spout having a sound opening, where the first opening is the sound opening and the second opening in the main housing portion, and wherein an armature leg portion extending through the opening extends along a general direction of the deflectable armature leg, the armature leg portion extending into the spout.

25. A method of operating a valve of a sound channel at least partly defined by a wall portion having therein an aperture, the sound channel including a valve having a closing element configured to, in a first position, close the aperture and, in a second position, not close the aperture, and an actuator, the actuator having:

a housing with an opening, the sound channel extending at least predominantly outside of the housing, and an electro-magnetic structure with a moving element, the electro-magnet structure being provided in the housing, wherein the moving element extends from inside the housing, through the opening to the closing element positioned outside of the housing, the method comprising:

feeding a current to a drive coil of the electro-magnetic structure so as to bring the closing element from one of the first and second positions to another of the first and second positions; and subsequently not feeding the current to the drive coil while a maintaining means maintains the closing element in the other of the first and second positions.

26. A transducer comprising an outer housing, a sound generator and a sound channel at least partly defined by a wall portion having therein an aperture, the sound channel including a valve having a closing element configured to, in a first position, close the aperture and, in a second position, not close the aperture, and an actuator, the actuator having:

a housing with an opening, the sound channel extending at least predominantly outside of the housing, and an electro-magnetic structure with a moving element, the electro-magnet structure being provided in the housing, wherein the moving element extends from inside the housing, through the opening to the closing element positioned outside of the housing, the sound generator and the valve being positioned in the outer housing, the outer housing having a first opening and a second opening, the aperture of the valve being positioned in a sound passage inside the outer housing and between the first opening and the second opening, wherein the outer housing comprises a main housing portion and a spout having a sound opening, where the first opening is the sound opening and the second opening in the main housing portion, and wherein the sound channel extends within the spout and, where:

the aperture is provided in the spout, the housing is provided in the main housing portion, and the moving element extends from the housing to the aperture.

* * * * *